US005316119A

United States Patent [19]

Sugimoto et al.

[11] Patent Number: 5,316,119

[45] Date of Patent: May 31, 1994

[54] METHOD AND APPARATUS FOR DISCRIMINATING BETWEEN TRUE AND FALSE COINS OR THE LIKE

[75] Inventors: Osamu Sugimoto, Iruma; Yonezo Furuya, Hatoyama; Ichiro Fukuda, Kawagoe, all of Japan

[73] Assignee: Nippon Conlux Co., Ltd., Tokyo, Japan

[21] Appl. No.: 766,750

[22] Filed: Sep. 27, 1991

[30] Foreign Application Priority Data

Mar. 27, 1991 [JP] Japan ..... 3-063575
Jul. 30, 1991 [JP] Japan ..... 3-190070

[51] Int. Cl.[5] ..... G07D 5/08
[52] U.S. Cl. ..... 194/318
[58] Field of Search ..... 194/317-319

[56] References Cited

U.S. PATENT DOCUMENTS 5,167,313 12/1992 Dobbins et al. ..... 194/317

FOREIGN PATENT DOCUMENTS 0219574 4/1987 European Pat. Off. ..... 194/317
0367921 5/1990 European Pat. Off. ..... 194/317
0384375 8/1990 European Pat. Off. ..... 194/317
2646025 4/1978 Fed. Rep. of Germany ..... 194/317
1-193988 8/1989 Japan ..... 194/317
91/06074 5/1991 PCT Int'l Appl. ..... 194/317

*Primary Examiner*—F. J. Bartuska

*Attorney, Agent, or Firm*—Spensley Horn Jubas & Lubitz

[57] ABSTRACT

There is provided a method and apparatus for discriminating between true and false coins wherein a coin satisfying both the electrical success conditions at their lowest levels is regarded as a false coin, and a coin satisfying at least one of the two electrical success conditions at a high level is regarded as a true coin.

According to the method discriminating apparatus is mounted relative to a predetermined passage along which a coin or the like to be discriminated passes, wherein true/false discrimination is carried out in accordance with whether or not the two or three different data detected from the coin and developed on a two- or three-dimensional coordinate system falls within a predetermined two- or three-dimensional function closed area. The apparatus includes: a coin passage along which a coin to be discriminated passes; exciting units mounted relative to the coin passage for exciting the coin passing along the coin passage; detecting units for detecting the state of the coin excited by the exciting units; and a unit for discriminating the coin between true and false in accordance with whether or not the data detected by the detecting units falls within a predetermined two or three-dimensional function closed area on a predetermined two or three-dimensional coordinate system.

6 Claims, 18 Drawing Sheets

METHOD AND APPARATUS FOR DISCRIMINATING BETWEEN TRUE AND FALSE COINS OR THE LIKE

BACKGROUND OF THE INVENTION

Field of the Invention

The present invention relates to a method and apparatus for electromagnetically discriminating between true and false coins or the like.

True and false coins have been discriminated by a mechanical method such as judging outer diameters for long years, and recently by an electrical method.

An electrical method discriminates between true and false coins by checking the electromagnetic characteristic of a coin falling along a coin passage in a coin discriminating apparatus by using a coin sensor mounted along the coil passage. One type of a coin sensor for discriminating between true and false coins uses exciting means for electromagnetically exciting a coin and means for detecting an electromagnetic response of the excited coin, and analyzes the detected response data. Another type of a coin sensor for discriminating between true and false coins uses a coil of an oscillator circuit mounted at one end of a coin passage to detect a shift of the oscillation frequency when a coil passes near the coil.

FIG. 17 shows an example of a conventional electronic discrimination circuit. This circuit has a first sensor 11 for detecting the electromagnetic characteristic of a coin at its central area, and a second sensor 12 for detecting the electromagnetic characteristic of the coin at its peripheral area. A signal detected by the first sensor 11 is supplied via a first signal generator means 13 and first peak signal generator means 15 to an A/D converter means 17 to be converted into a digital signal. A signal detected by the second sensor 12 is supplied via a second signal generator means 14 and second peak signal generator means 16 to the A/D converter means 17 to be converted into a digital signal. Each digital signal is compared with a reference value from a reference value storage means 32 or 34 at a comparison/discrimination means 31 or 33 in a CPU to discriminate between true and false. The discrimination result is outputted to an AND circuit 35. The AND circuit 35 outputs a logical product of the two electrical success conditions set by the two sensor systems, so that a coin satisfying the two electrical success conditions only is regarded as a true coin. FIG. 18 is a flow chart including steps S1 to S8 for executing the above discrimination operation.

A coin satisfying the two electrical success conditions at their lowest level is obviously regarded as a true coin. However, it has been found empirically that a coin satisfying the two electrical success conditions at their lowest levels should be regarded as a false coin rather than a true coin. Although if a coin satisfies one of the two electrical success conditions at a sufficiently high level, it can be regarded as a true coin.

SUMMARY OF THE INVENTION

The present invention has been made considering the above circumstances. It is an object of the present invention to provide a method and apparatus for discriminating between true and false coins wherein a coin satisfying both the electrical success conditions at their lowest levels is regarded as a false coin, and a coin satisfying at least one of the two electrical success conditions at a high level is regarded as a true coin.

In order to achieve the above object, according to the first aspect of the present invention, there are provided a method of discriminating between true and false coins or the like by mounting a discriminating means relative to a predetermined passage along which a coin or the like to be discriminated passes, wherein true/false discrimination is carried out in accordance with whether or not the data detected from the coin and developed on a coordinate system falls within a predetermined function closed area, and an apparatus of discriminating between true and false coins, comprising: a coin passage along which a coin to be discriminated passes; exciting means mounted relative to the coin passage for exciting the coin passing along the coin passage; detecting means for detecting the state of the coin excited by the exciting means; and discriminating means for discriminating the coin between true and false in accordance with whether or not the data detected by the detecting means falls within a predetermined function closed area on a predetermined coordinate system.

In order to achieve the above object, according to the second aspect of the present invention, there are provided a method of discriminating between true and false coins or the like by mounting a discriminating means relative to a predetermined passage along which a coin or the like to be discriminated passes, wherein true/false discrimination is carried out in accordance with whether or not the three different data detected from the coin and developed on a three-dimensional coordinate system falls within a predetermined three-dimensional function closed area, and an apparatus of discriminating between true and false coins, comprising: a coin passage along which a coin to be discriminated passes; exciting means mounted relative to the coin passage for exciting the coin passing along the coin passage; three detecting means for detecting the state of the coin excited by the exciting means; and discriminating means for discriminating the coin between true and false in accordance with whether or not the three data detected by the three detecting means fall within a predetermined three-dimensional function closed area on a predetermined three-dimensional coordinate system.

According to the first aspect of the present invention, if one electrical (dimensional) success condition of a coin is plotted along an ordinate of a coordinate system and the other electrical (material) success condition is plotted along the abscissa, an area on the coordinate system which satisfies both the conditions takes a shape of a circle having its center at a certain point. The data detected from a coin falls within the circle if one of the two condition is satisfied.

If the data detected from a coin passing through the passage satisfies the two electrical conditions at their lowest levels, it falls outside of the circle.

Discrimination between true and false coins is executed by the discriminating means depending upon whether the data detected from a coin falls within the function closed area or not. The function closed area represents the reference value. The function closed area is a circle or takes a shape of generally a circle.

According to the second aspect of the present invention, if three data detected by the three detecting means are developed on X, Y, and Z three axes of a three-dimensional coordinate system, an area on the coordinate system which satisfies the success condition as a true coin takes a configuration of a sphere having its center at a certain point.

If the data detected from a coin passing through the passage satisfies the three electrical conditions at their lowest levels, it falls outside of the sphere.

Discrimination between true and false coins is executed by the discriminating means depending upon whether the data detected from a coin falls within the sphere, i.e., the three-dimensional function closed area or not. The function closed area represents the reference value. The three-dimensional function closed area is a sphere or takes a configuration of generally a sphere.

According to the present invention, discrimination between true and false coins is executed using a three-dimensional function closed area on a three-dimensional coordinate system defined by three coin success conditions. Therefore, a false coin which was regarded as a true coin according to a conventional technique, can be reliably discriminated as a false coin, thereby preventing a use of a false coin at an automatic vending machine or the like.

DETAILED DESCRIPTION OF THE PREFERRED EMBODIMENTS

Figure 1:
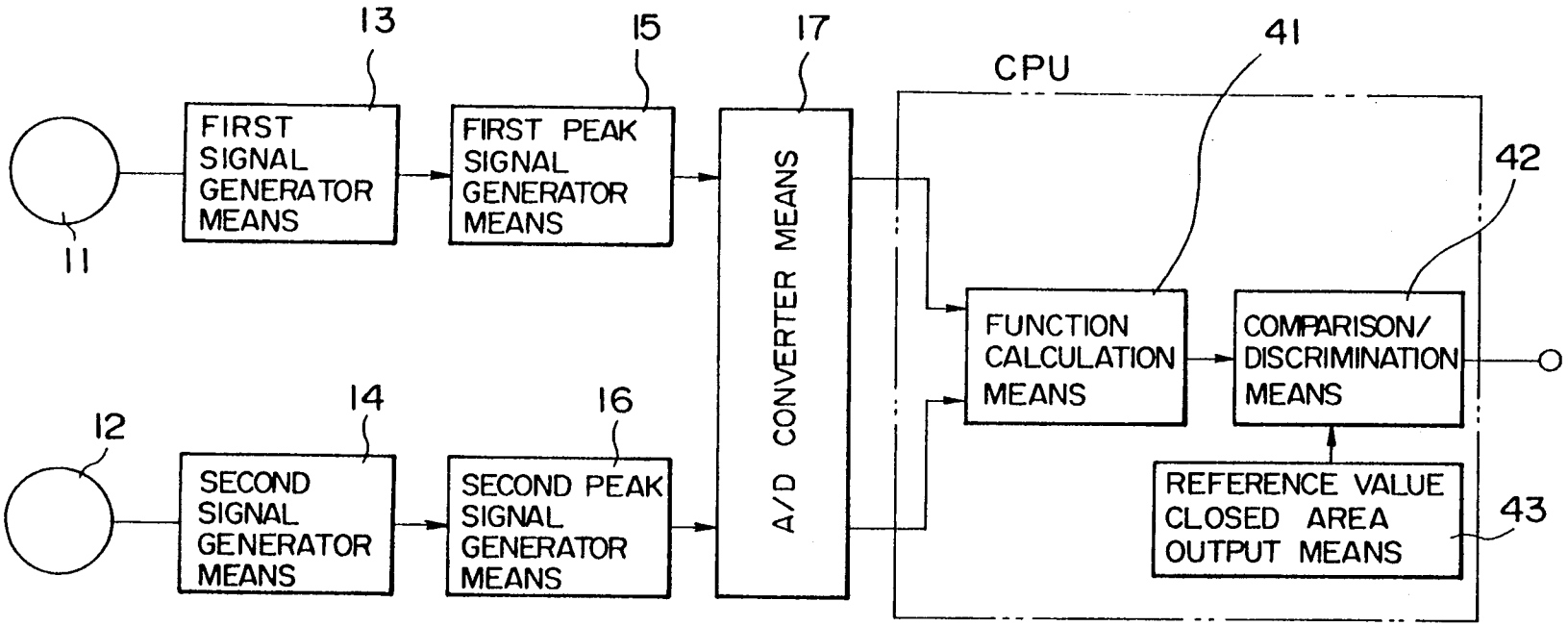
FIG. 1 is a block diagram showing the circuit arrangement of an embodiment according to the present invention.
Figure 17:
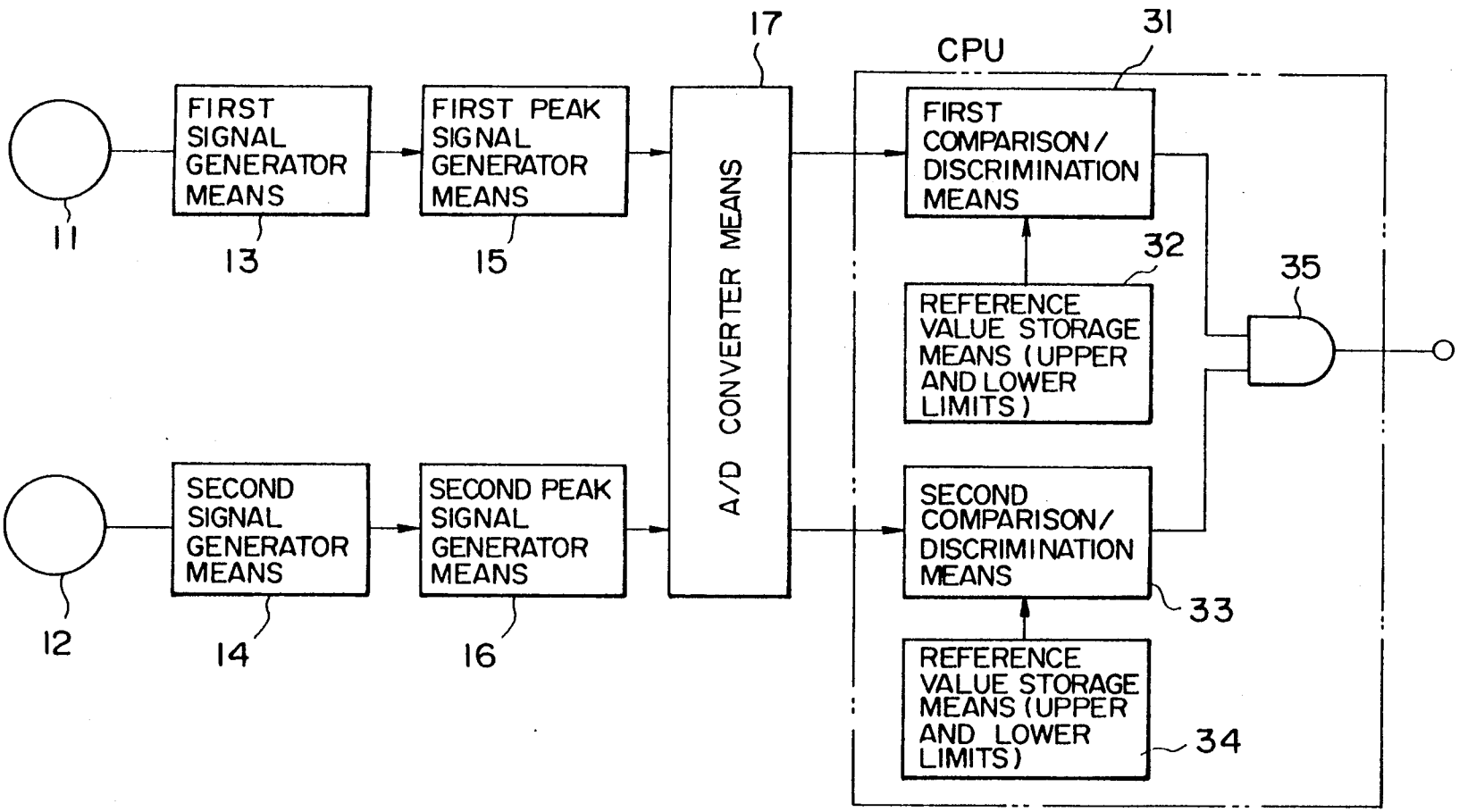
FIG. 17 PRIOR ART
FIG. 17 is a circuit diagram of a conventional electronic discrimination circuit.

FIG. 1 is a block diagram showing the circuit arrangement of a first embodiment according to a first aspect of the present invention. The circuit arrangement in a CPU is different from that shown in FIG. 17, and the other circuit portion is the same as that shown in FIG. 17. In CPU, outputs from the A/D converter means 17 are supplied to and processed by a function calculation/processing means 41. The processed value is compared at a comparison/discrimination means 42 with a reference value from a reference value output means 43. The reference value represents a function closed area.

The subject to be discriminated is not limited only to coins, but other subjects may be used such as tokens, metals, notes, cards, and the like.

The operation of CPU will be later described in detail with reference to the accompanying flow charts.

Figure 2:
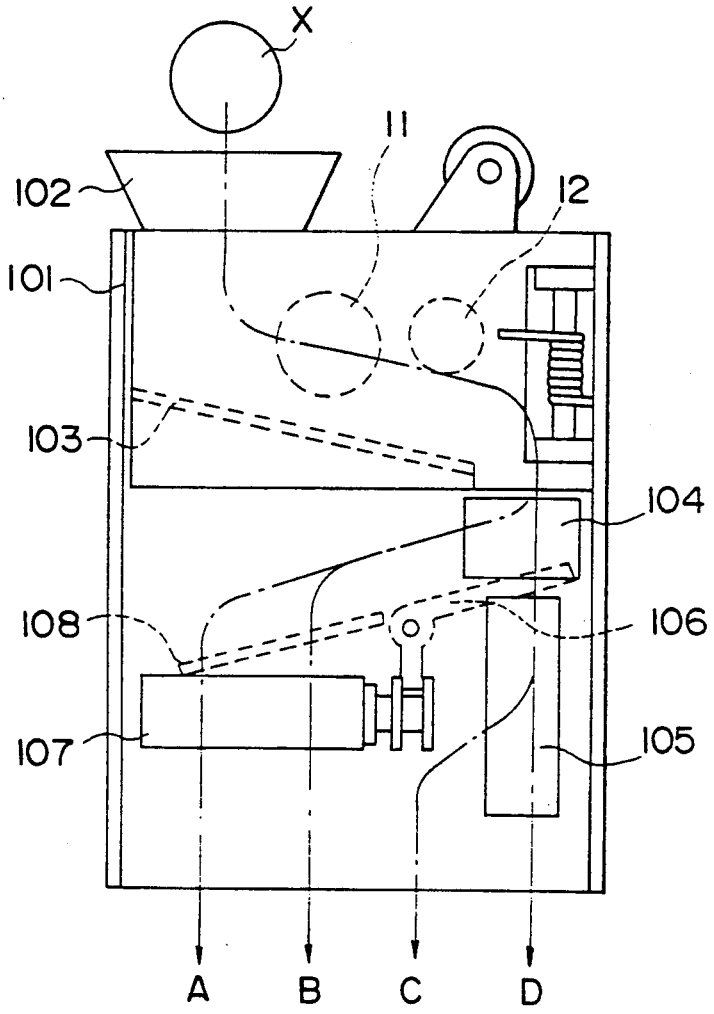
FIG. 2 is a schematic diagram showing the mechanical structure of a coin discriminating apparatus according to the present invention.

FIG. 2 shows the mechanical structure of a coin discriminating apparatus according to the present invention. A coin X is inserted into the main body 101 of the apparatus via a coin inlet 102 formed at one end of the top plate of the apparatus. The coin X moves downward along a rail 103. While the coin X moves downward along the rail 103, the electromagnetic characteristics of the coin are detected by coin sensors 11 and 12. A coin true/false separator piece 104 is mounted at the right end of the rail 103. The separator piece 104 is operated by a separator solenoid 105 to guide a true or false coin to a true coin passage or false coin passage (not shown).

True coins are sent to coin passages A, B, C, and D indicated by one-dot chain lines and provided for each kind of coin. True coins are selected into respective kinds by a selection piece 106 which is operated by a selection solenoid 107. The selection piece 106 is not operated when coins are guided to the passages A and B, but it is operated when coins are guided to the passages C and D. Coins are further guided to each of the passages A, B, C, and D by each selection mechanism mounted on each passage.

Coins falling to a false coin passage are ejected out of the apparatus via an outlet (not shown).

Figure 3:
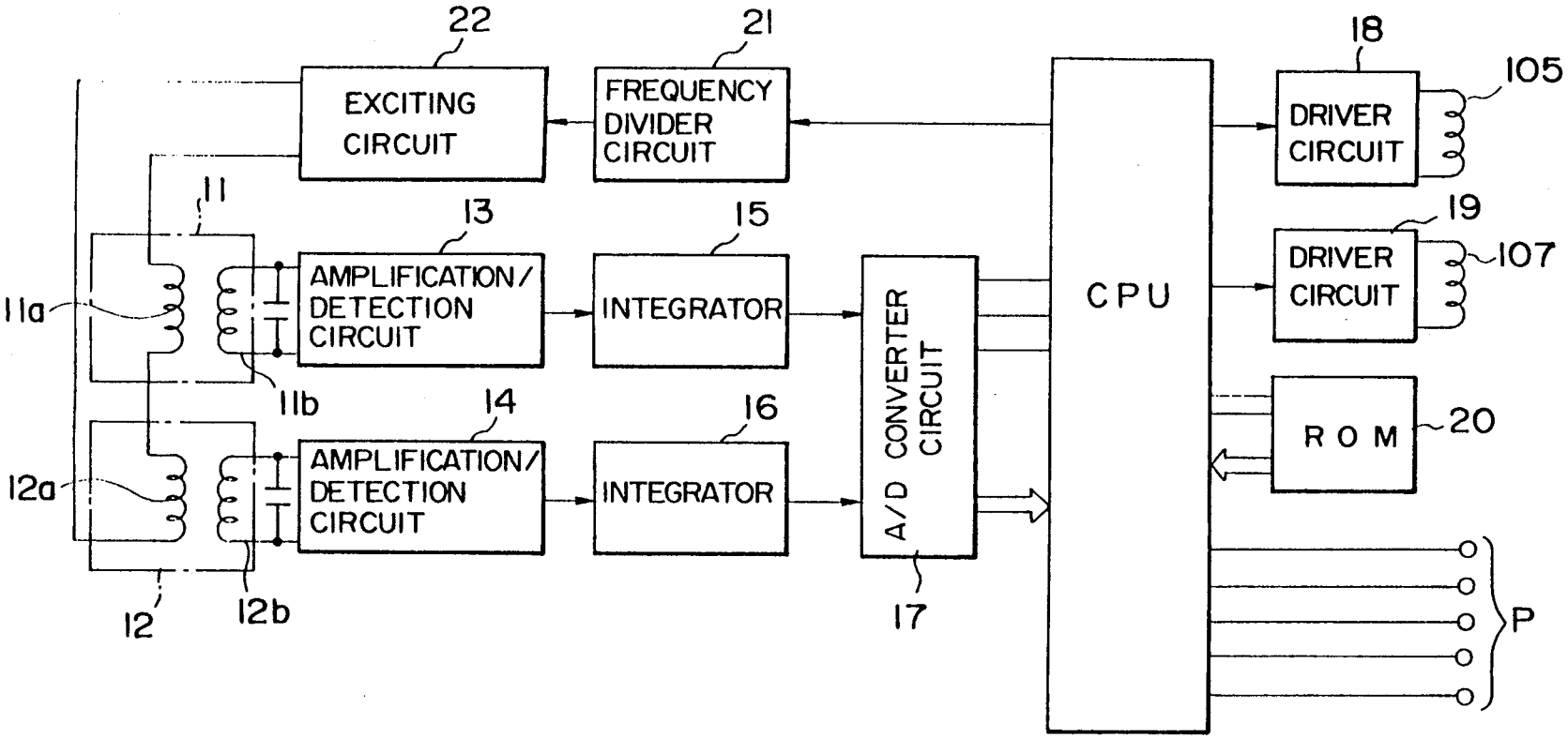
FIG. 3 is a detailed circuit diagram, partially in block, of the circuit shown in FIG. 1.

FIG. 3 is a detailed circuit diagram, partially in block, of the circuit shown in FIG. 1. Referring to FIG. 3, CPU supplies a signal having a predetermined frequency to an exciting circuit 22 via a frequency divider 21 so that an exciting current flows to exciting coils 11*a* and 12*a* of the sensors 11 and 12. Electromagnetic fields generated by the exciting coils 11*a* and 12*a* are detected by detecting coils 11*b* and 12*b*. The magnitudes of the detected electromagnetic fields depend upon whether or not a coin passes between the exciting and detecting coils and the kind of the coin.

The electromagnetic fields detected by the detecting coils are supplied via amplification/detection circuits 13 and 14 to integrator circuits 15 and 16 to detect peak signals. These peak signals are supplied to an A/D converter circuit 17 to convert them into digital signals which are then supplied to CPU.

CPU checks the received digital signals in accordance with a procedure given by a predetermined program in a ROM 20 to thereby select a false coin, if any, by using the separator solenoid 105 and separator piece 104 and to select coins into each coin kind by using the selection solenoid 107 and selection piece 106.

Five terminals P of CPU are connected to external circuits (not shown).

Figure 4:
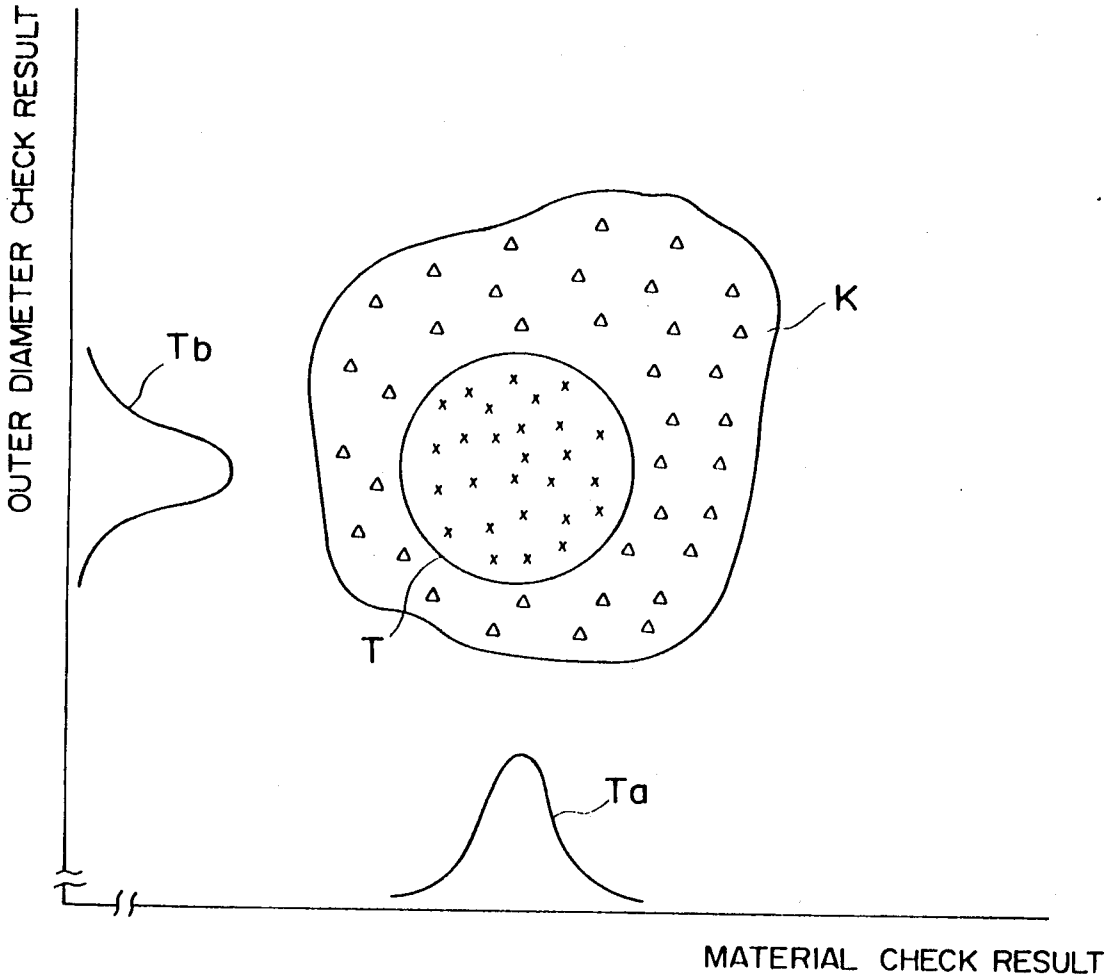
FIG. 4 is a graph obtained through experiments illustrating the true/false discrimination according to the present invention.

FIG. 4 is a graph obtained through experiments illustrating the true/false discrimination according to the present invention. The abscissa represents a material quality check result, and the ordinate represents an outer diameter check result. In this graph, T represents an area generally of a circle. A coin whose characteristics fall within this circle area is regarded as a true coin. Another area K surrounding the area T is used for discriminating a false coin.

The distribution of check results is represented by normal distribution curves Ta and Tb, respectively on the abscissa and ordinate axes. The skirt portions of the normal distribution curves define an area generally of a rectangle including the circle area T. The four corner areas within the rectangular area excepting the circle area are used for discriminating a false coin. In this embodiment, in order to discriminate between true and false coins, a calculation is executed whether or not the detected data is within the circle area or not by using an equation of a circle.

Figure 5:
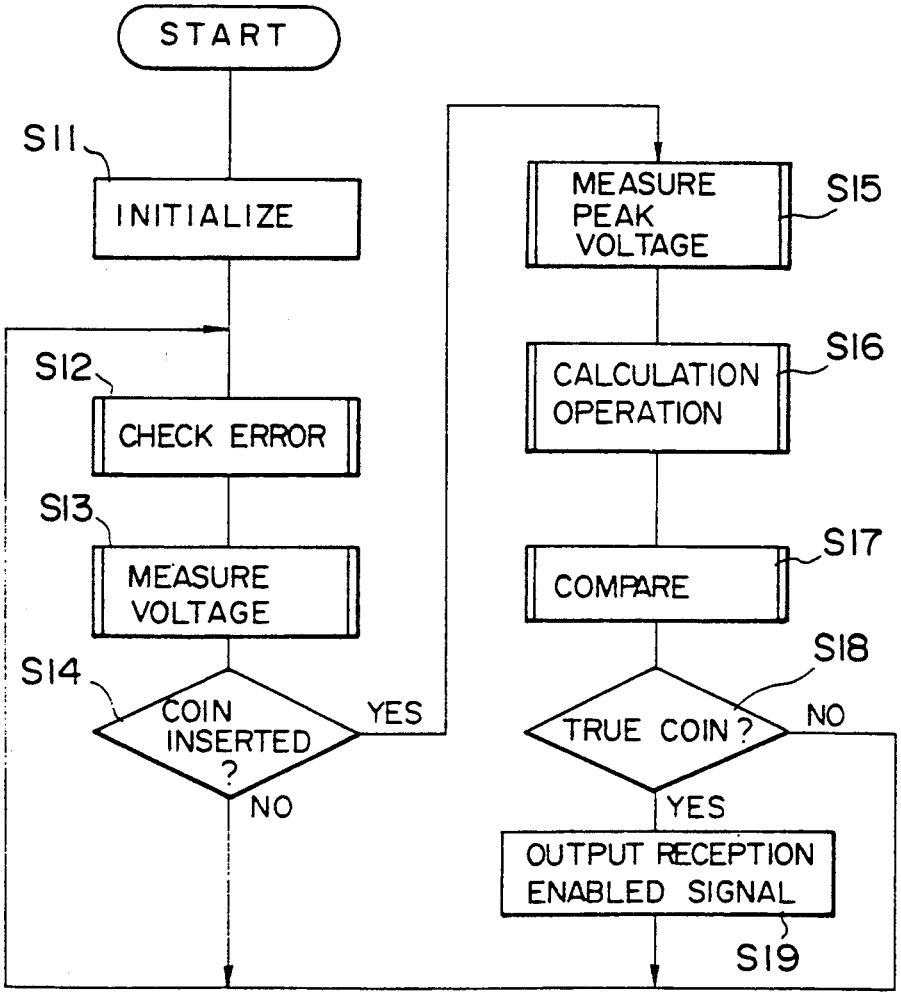
FIG. 5 is a flow chart illustrating the operation according to the present invention, corresponding to FIG. 18.
Figure 18:
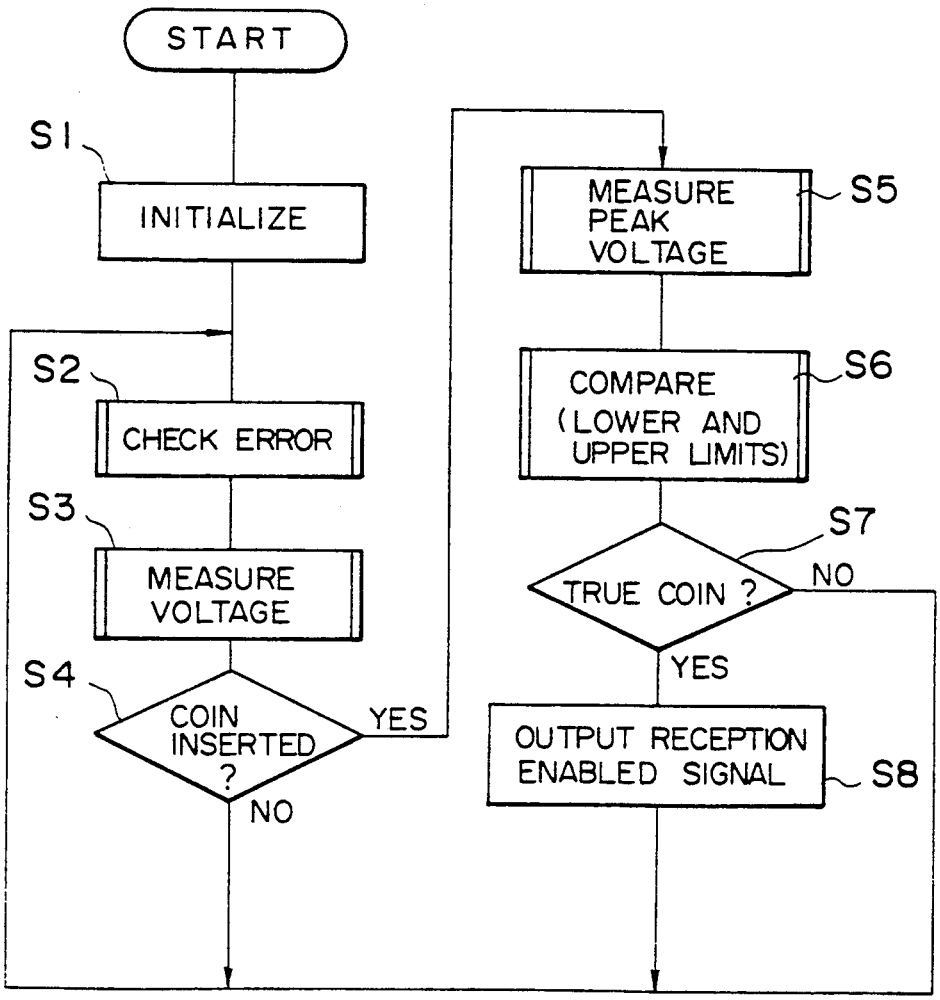
FIG. 18 PRIOR ART
FIG. 18 is a flow chart illustrating the operation of the conventional electronic discrimination circuit.

FIG. 5 is a flow chart showing the main routine according to the present invention, this flow chart corresponding to that shown in FIG. 18 of the conventional technique. The coin true/false discrimination is carried out the operations at steps S11 to S19. Specifically, at the start of operation, CPU is initialized at step S11, then any error is checked at step S12. After the measurement is allowed to be executed, a voltage is measured at step S13. It is judged at step S14 if a coin has been inserted or not, in accordance with a presence or absence of the measured voltage. If any voltage corresponding to a coin insertion is not measured, the flow returns to step S12.

In a voltage corresponding to a coin insertion is measured, a peak voltage is measured at step S15. Using this peak voltage, a calculation is made at step S16. This calculated value is compared at step S17. A true coin flag is set for a true coin, and not set for a false coin. It is judged at step S18 if the true coin flag has been set or not by the comparison result. If the true coin flag has been set, a reception enabled signal is outputted, and if not, the flow returns to step S12.

Figure 6:
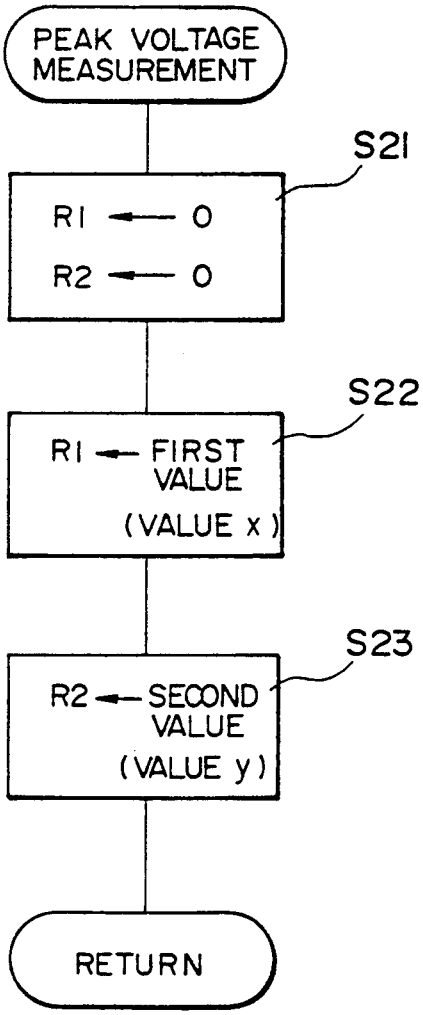
FIG. 6 is a flow chart detailing the peak voltage measurement at step S15 in FIG. 5.
Figure 7:
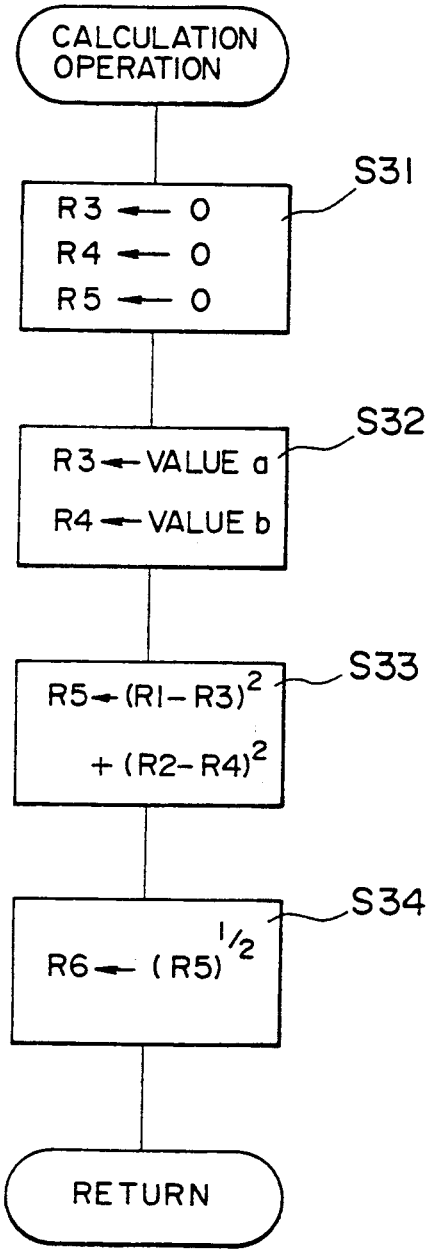
FIG. 7 is a flow chart detailing the calculation operation at step S16 in FIG. 5.
Figure 8:
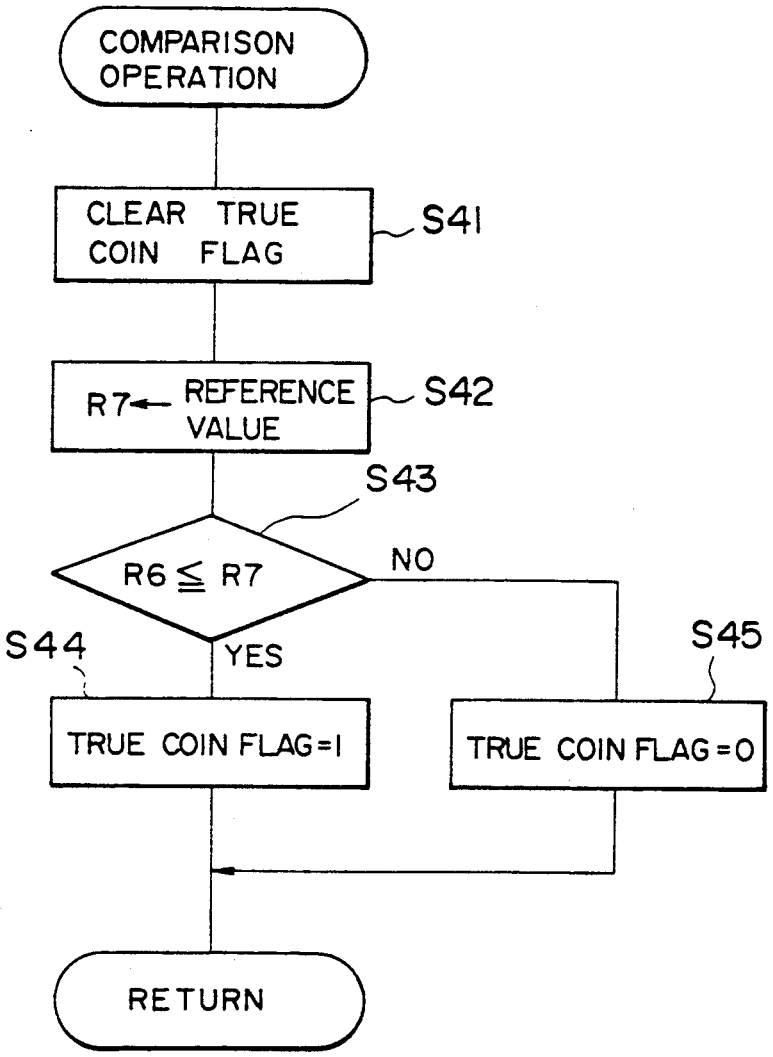
FIG. 8 is a flow chart detailing the comparison operation at step S17 in FIG. 5.

FIGS. 6 to 8 are flow charts of the subroutines of the flow chart shown in FIG. 5. These subroutines detail the contents of the peak voltage measurement at step S15, the calculation operation at step S16, and the comparison operation at step S17.

In the peak voltage measurement shown in FIG. 6, the values of registers (not shown) in CPU are set to "0" at step S21. The value R1 of a first register is set to the peak value obtained using the first sensor, at step S22. The value R2 of a second register is set to the peak value obtained using the second sensor, at step S23.

The above operation will be described with reference to the block diagram shown in FIG. 1. The peak values supplied from the peak signal generator means 15 and 16 via the A/D converter means 17 and obtained using the first and second sensors 11 and 12, are loaded in two registers contained in the function calculation/processing means 41.

In the calculation operation shown in FIG. 7, the values R3, R4, R5, and R6 of third to sixth registers of the function calculation/processing means 41 shown in FIG. 1 are set to "0" at step S31. At step S32 the X coordinate value a representative of the center position of the circle is loaded in the third register, and the Y coordinate value b is loaded in the fourth register.

Next, at step S33 a calculation of $(R1-R3)^2+(R2-R4)^2=R5$ is carried out using the loaded values R1 to R4 in the first to fourth registers. The root value of R5, $(R5)^{\frac{1}{2}}$, is a radius of the circle, which is loaded as a value R6 in the sixth register.

In the comparison operation shown in FIG. 8, the true coin flag in the comparison/discrimination means 42 shown in FIG. 1 is cleared at step S41. At step S42, the reference value from the reference value output means 43 is loaded as R7 in a seventh register contained in the comparison/discrimination means 42. The values R6 in the sixth register and the value R7 in the seventh register are compared with each other at step S43. If $R6 \leqq R7$ stands, the true coin flag is set to "1" at step S44. If not, at step S45 the true coin flag is not set.

In the above manner, an inserted coin is discriminated between true and false by checking if the detected data of the coin is within the circle or not. If the detected data is not within the circle, the coin is regarded as false and ejected out.

In the above embodiment, a circle is used as the function closed area. Instead of the circle, an ellipsoid, an elongated circle or the like may also be used, depending upon the kind of coins to be discriminated, and the type of the detecting means.

Figure 9:
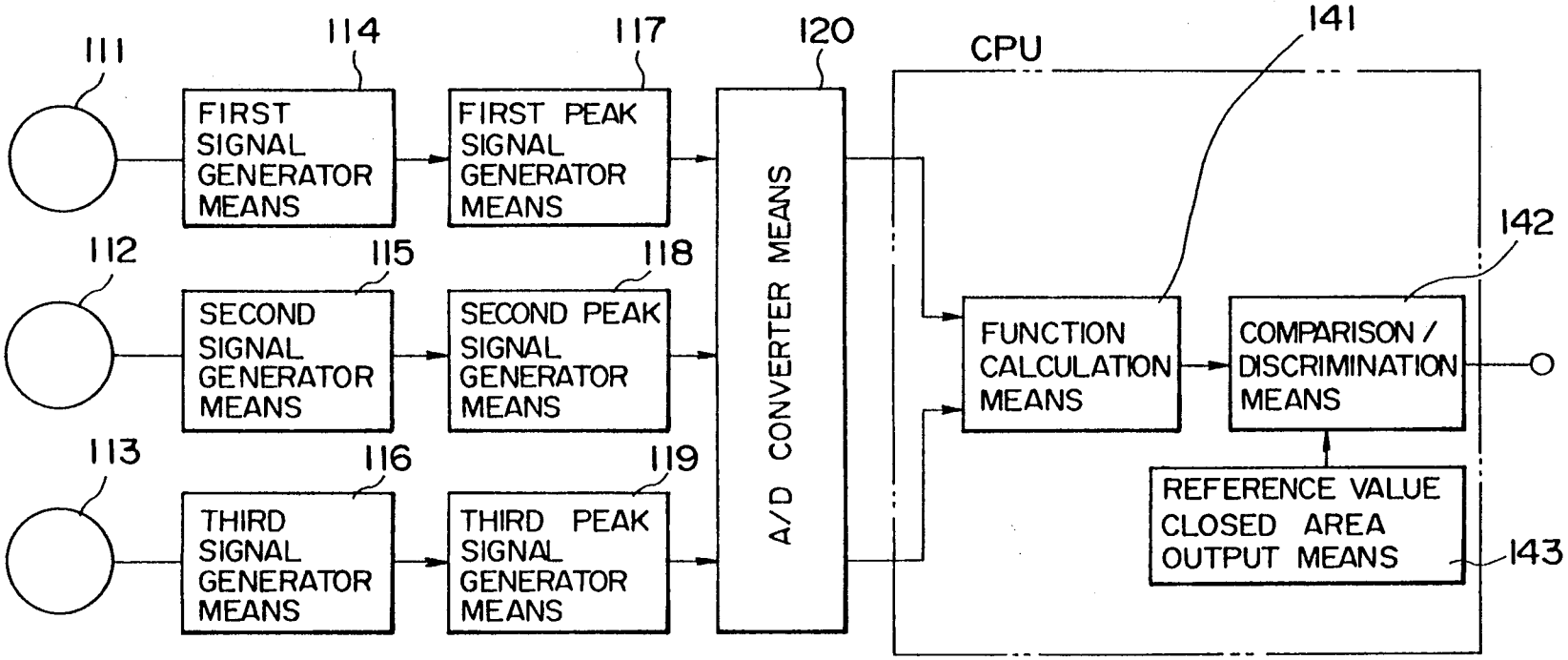
FIG. 9 is a block diagram showing the circuit arrangement of another embodiment according to the present invention.

FIG. 9 is a block diagram showing the circuit arrangement of a first embodiment according to a second aspect of the present invention. The circuit arrangement in a CPU is different from that shown in FIG. 17, and the other circuit portion is the same as that shown in FIG. 17. There are provided three sensors 111, 112, and 113. The outputs from the three sensors are supplied via first to third signal generator means 114, 115, and 116, and first to third peak signal generator means 117, 118, and 119, to an A/D converter means 120. In CPU, outputs from the A/D converter means 120 are supplied to and processed by a function calculation/processing means 141. The processed value is compared at a comparison/discrimination means 142 with a reference value from a reference value output means 143. The reference value represents a three-dimensional function closed area.

The subject to be discriminated is not limited only to coins, but other subjects may be used such as tokens, metals, notes, cards, and the like.

The operation of CPU will be later described in detail with reference to the accompanying flow charts.

Figure 10:
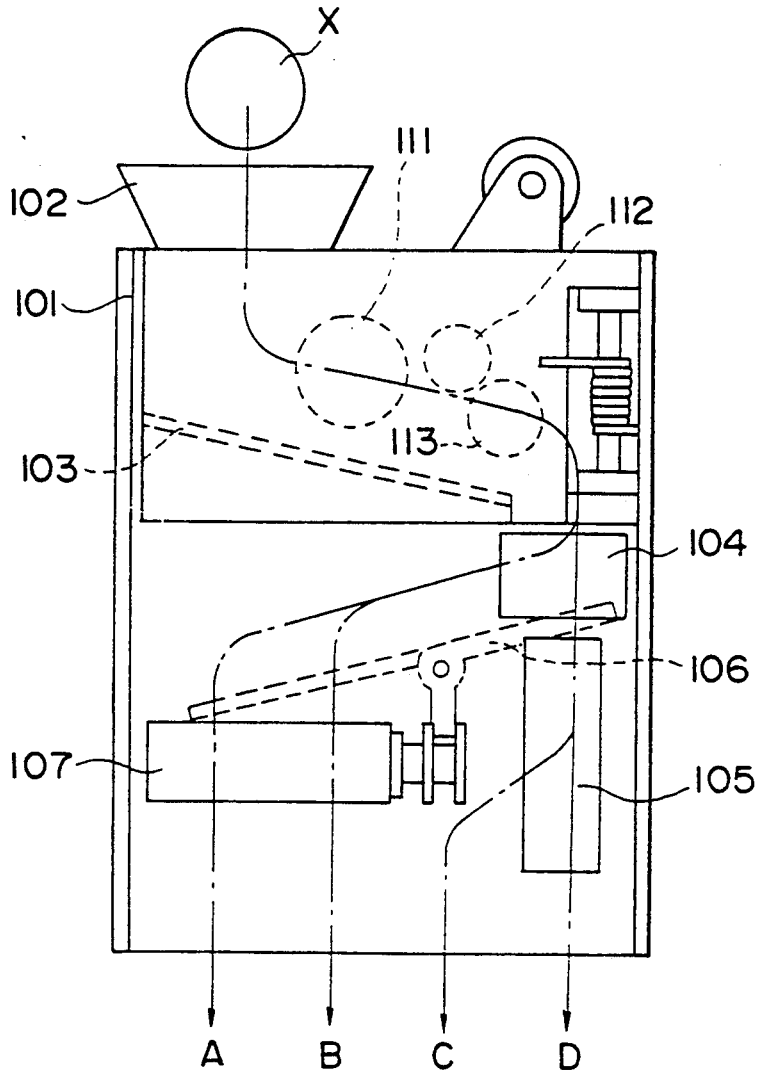
FIG. 10 is a schematic diagram showing the mechanical structure of a coin discriminating apparatus according to the present invention.

FIG. 10 shows the mechanical structure of a coin discriminating apparatus according to the present invention. A coin X is inserted into the main body 101 of the apparatus via a coin inlet 102 formed at one end of the top plate of the apparatus. The coin X moves downward along a rail 103. While the coin X moves downward along the rail 103, the electromagnetic characteristics of the coin are detected by the coin sensors 111, 112, and 113. A coin true/false separator piece 104 is mounted at the right end of the rail 103. The separator piece 104 is operated by a separator solenoid 105 to guide a true or false coin to a true coin passage or false coin passage (not shown).

True coins are sent to coin passages A, B, C, and D indicated by one-dot chain lines and provided for each kind of coin. True coins are selected into respective kinds by a selection piece 106 which is operated by a selection solenoid 107. The selection piece 106 is not operated when coins are guided to the passages A and B, but it is operated when coins are guided to the passages C and D. Coins are further guided to each of the passages A, B, C, and D by each selection mechanism mounted on each passage.

Coins falling to a false coin passage are ejected out of the apparatus via an outlet (not shown).

Figure 11:
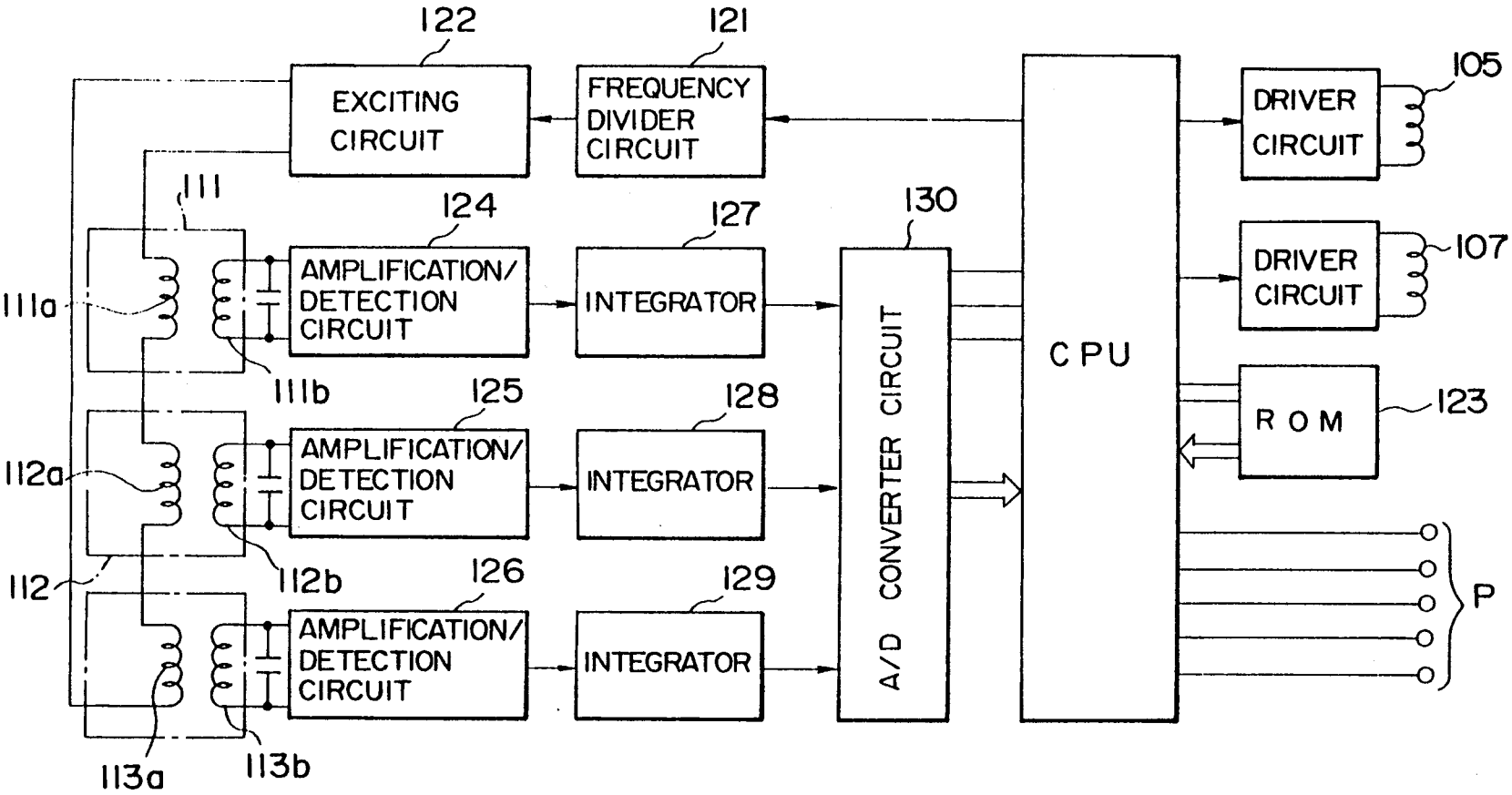
FIG. 11 is a detailed circuit diagram, partially in block, of the circuit shown in FIG. 9.

FIG. 11 is a detailed circuit diagram, partially in block, of the circuit shown in FIG. 9. Referring to FIG. 11. CPU supplies a signal having a predetermined frequency to an exciting circuit 122 via a frequency divider 121 so that an exciting current flows to exciting coils 111*a*, 112*a*, and 113*a* of the sensors 111, 112, and 113. Electromagnetic fields generated by the exciting coils 111*a* to 113*a* are detected by detecting coils 111*b* to 113*b*. The magnitudes of the detected electromagnetic fields depend upon whether or not a coin passes between the exciting and detecting coils and the kind of the coin.

The electromagnetic fields detected by the detecting coils 111*b*, 112*b*, and 113*b* are supplied via amplification/detection circuits 124, 125, and 126 to integrator circuits 127, 128, and 129 to detect peak signals. These peak signals are supplied to the A/D converter circuit 130 to convert them into digital signals which are then supplied to CPU.

CPU checks the received digital signals in accordance with a procedure given by a predetermined program in a ROM 123 to thereby select a false coin, if any, by using the separator solenoid 105 and separator piece 104 and to select coins into each coin kind by using the selection solenoid 107 and selection piece 106.

Five terminals P of CPU are connected to external circuits (not shown).

Figure 12:
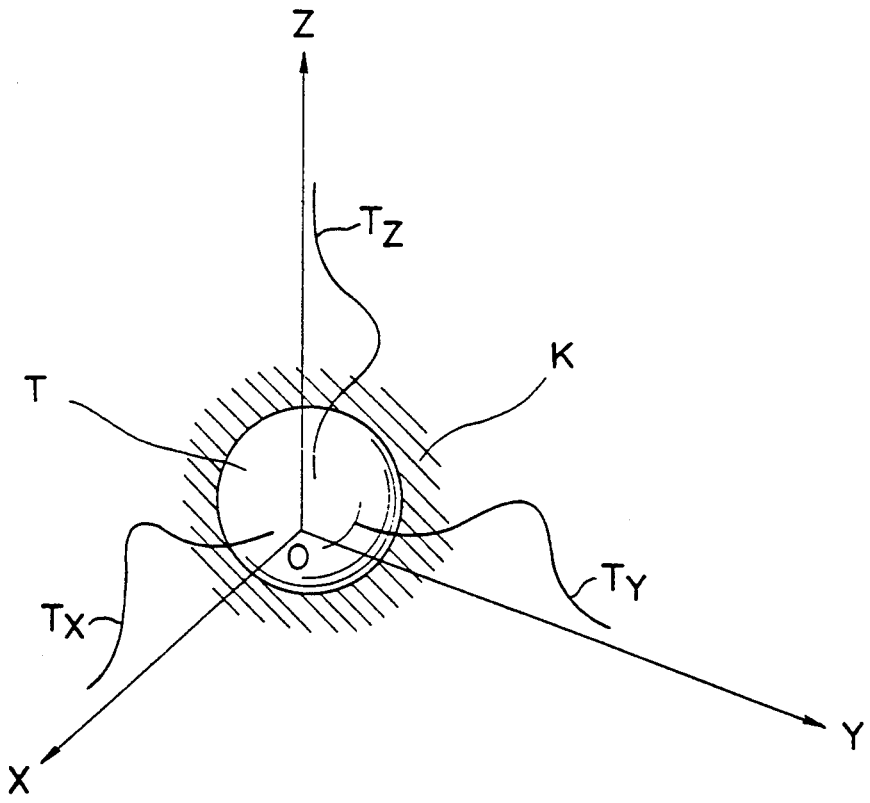
FIG. 12 is a graph obtained through experiments illustrating the true/false discrimination according to the present invention.

FIG. 12 is a graph obtained through experiments illustrating the true/false discrimination according to the present invention. The outputs for the three sensors 111, 112, and 113 are developed onto the three axes X, Y, and Z. In this graph, T represents an area generally of a sphere. A coin whose characteristics fall within this sphere area is regarded as a true coin. Another area K surrounding the sphere area T is used for discriminating a false coin.

The distribution of measured data through experiments is represented by normal distribution curves Tx, Ty, and Tz, respectively on the X, Y, and Z axes. The skirt portions of the normal distribution curves define an area generally of a cube including the sphere area T. The eight corner areas within the cube area excepting the sphere area are used for discriminating a false coin. In this embodiment, in order to discriminate between true and false coins, a calculation is executed whether or not the detected data is within the sphere area or not by using an equation of a sphere.

Figure 13:
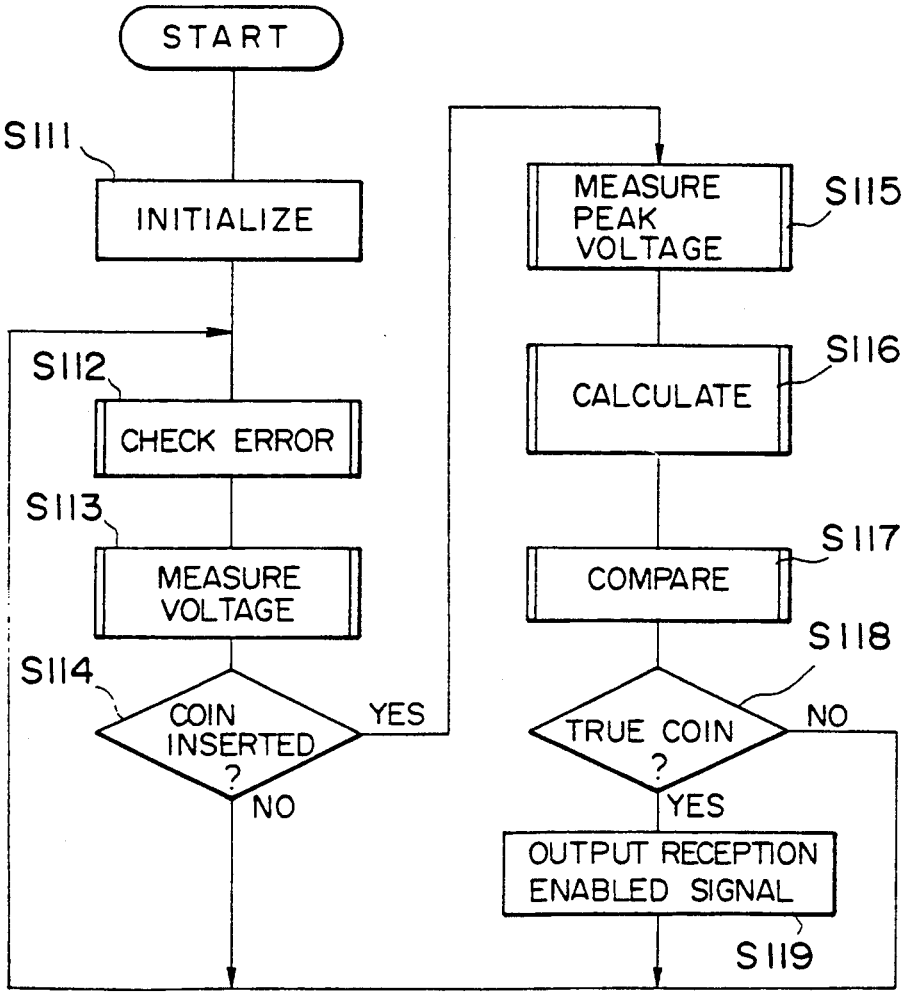
FIG. 13 is a flow chart illustrating the operation according to the present invention, corresponding to FIG. 18.

FIG. 13 is a flow chart showing the main routine according to the present invention, this flow chart corresponding to that shown in FIG. 18 of the conventional technique. The coin true/false discrimination is carried out the operations at steps S111 to S119. Specifically, at the start of operation, CPU is initialized at step S111, then any error is checked at step S112. After the measurement is allowed to be executed, a voltage is measured at step S113. It is judged at step S114 if a coin has been inserted or not, in accordance with a presence or absence of the measured voltage. If any voltage corresponding to a coin insertion is not measured, the flow returns to step S112.

If a voltage corresponding to a coin insertion is measured, a peak voltage is measured at step S115. Using this peak voltage, a calculation is made at step S116. This calculated value is compared at step S117. A true coin flag is set for a true coin, and not set for a false coin. It is judged at step S118 if the true coin flag has been set or not by the comparison result. If the true coin flag has been set, a reception enabled signal is outputted, and if not, the flow returns to step S112.

Figure 14:
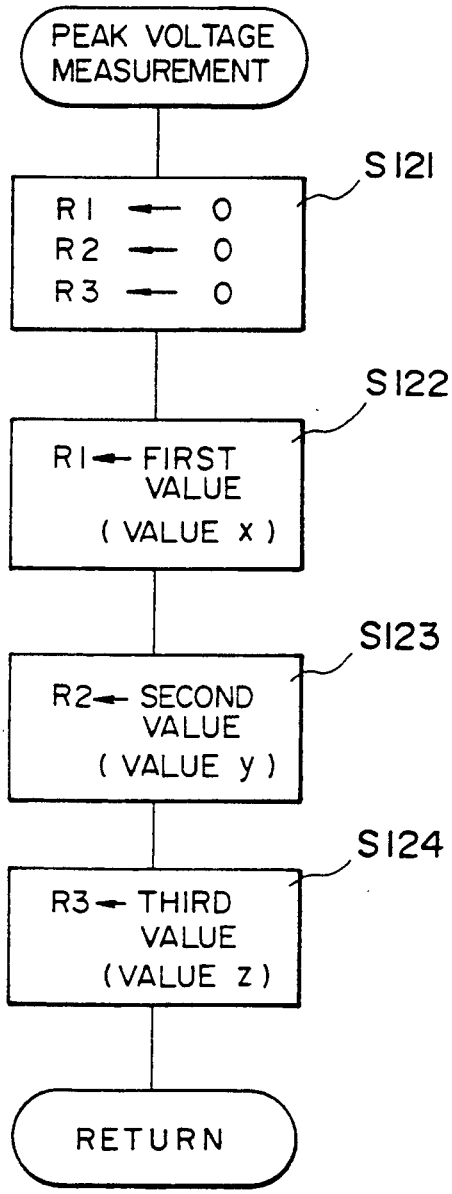
FIG. 14 is a flow chart detailing the peak voltage measurement at step S115 in FIG. 13.
Figure 15:
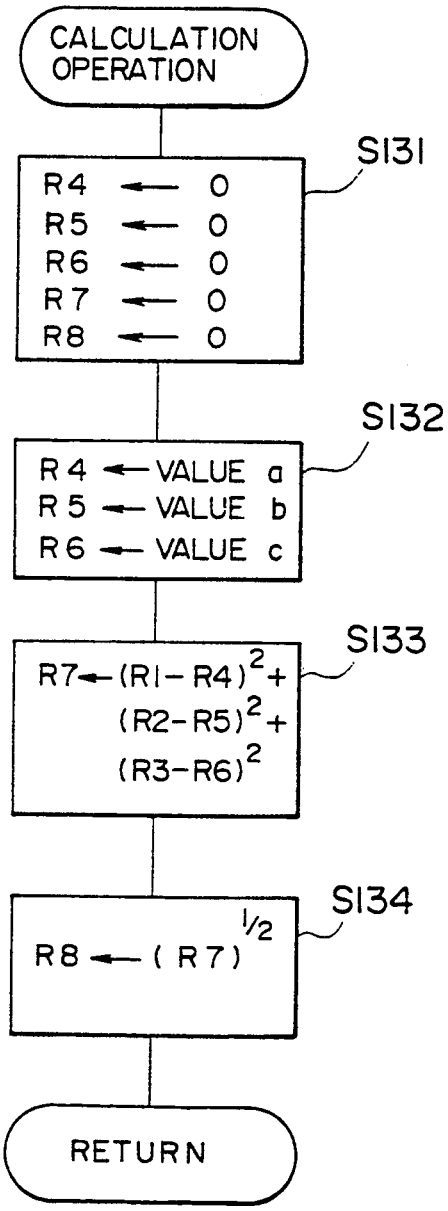
FIG. 15 is a flow chart detailing the calculation operation at step S116 in FIG. 13.
Figure 16:
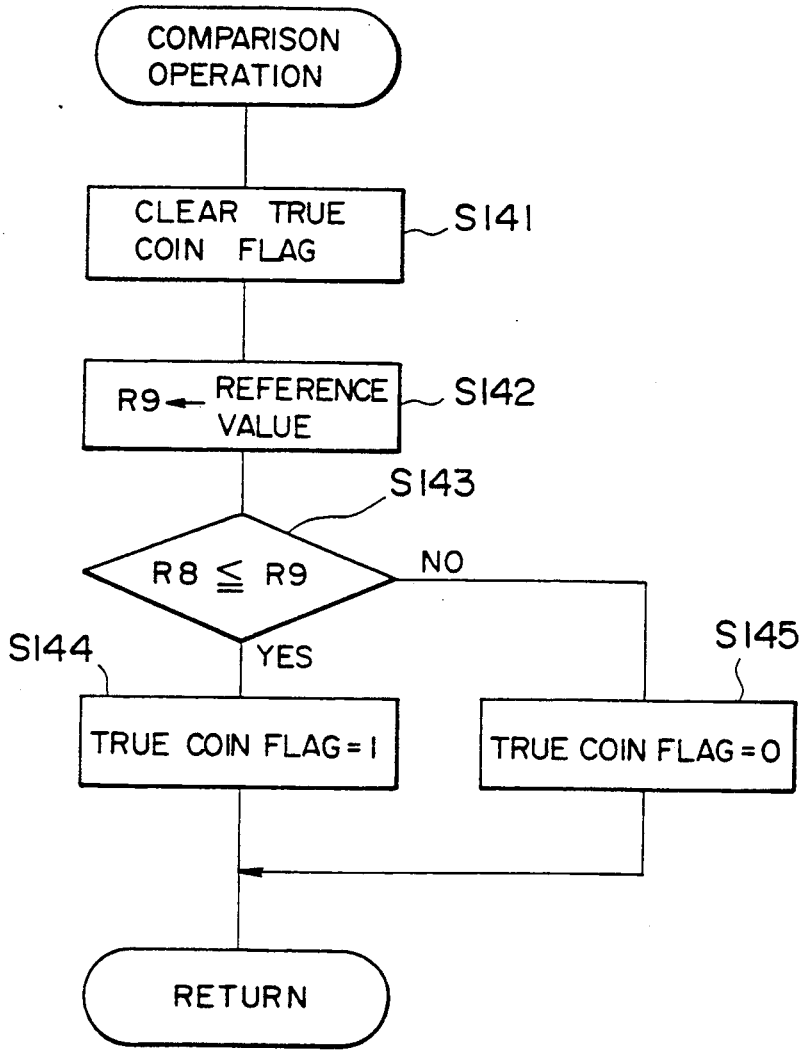
FIG. 16 is a flow chart detailing the comparison operation at step S117 in FIG. 13.

FIGS. 14 to 16 are flow charts of the subroutines of the flow chart shown in FIG. 13. These subroutines detail the contents of the peak voltage measurement at step S115, the calculation operation at step S116, and the comparison operation at step S117.

In the peak voltage measurement shown in FIG. 14 the values of registers (not shown) in CPU are set to "0" at step S121. The value R1 of a first register is set to the peak value obtained using the first sensor, at step S122. The value R2 of a second resister is set to the peak value obtained using the second sensor, at step S123. The value R3 of a third register is set to the peak value obtained using the third sensor, at step S124.

The above operation will be described with reference to the block diagram shown in FIG. 9. The peak values supplied from the peak signal generator means 117 to 119 via the A/D converter means 120 and obtained using the three sensors 111, 112, and 113, are loaded in three registers contained in the function calculation/processing means 141.

In the calculation operation shown in FIG. 15, the values R4, R5, R6, R7, and R8 of fourth to eighth registers of the function calculation/processing means 141 shown in FIG. 9 are set to "0" at step S131. At step S132 the X coordinate value a representative of the center position of the sphere is loaded in the fourth register, the Y coordinate value b is loaded in the fifth register, and the Z coordinate value c is loaded in the sixth register.

Next, at step S133 a calculation of $(R1-R4)^2+(R2-R5)^2+(R3-R6)^2=R7$ is carried out using the loaded values R1 to R6 in the first to sixth registers. The root value of R7, $(R7)^{\frac{1}{2}}$, is a radius of the sphere, which is loaded as a value R8 in the eighth register.

In the comparison operation shown in FIG. 16, the true coin flag in the comparison/discrimination means 142 shown in FIG. 9 is cleared at step S141. At step S142, the reference value from the reference value output means 143 is loaded as R9 in a ninth register contained in the comparison/discrimination means 142. The values R8 in the eighth register and the value R9 in the ninth register are compared with each other at step S143. If $R8 \leqq R9$ stands, the true coin flag is set to "1" at step S144. If not, at step S145 the true coin flag is not set.

In the above manner, an inserted coin is discriminated between true and false by checking if the detected data of the coin is within the sphere or not. If the detected data is not within the sphere, the coin is regarded as false and ejected out.

In the above embodiment, a sphere is used as the three-dimensional function closed area. Instead of the sphere, other configuration derived based on an ellipsoid, an elongated circle or the like may also be used, depending upon the kind of coins to be discriminated, and the type of the detecting means.

What is claimed is:

1. A method of discriminating between true and false coins by mounting a discriminating means relative to a predetermined passage along which a coin to be discriminated passes, wherein true/false discrimination is carried out in accordance with whether or not data detected from said coin and developed on a coordinate system falls within a predetermined function closed area, characterized in that said method comprises the steps of;

applying an electromagnetic field of given frequency to a coin which passes along said predetermined passage to excite the coin;

detecting a state of said coin excited by the electromagnetic field; and discriminating said coin between true and false in accordance with whether or not the data representing the state of said coin falls within a circular area on a predetermined two-dimensional coordinate system which represents two parameters, including material quality and an outer diameter of said coin, the radius of said circular area being represented by a characterizing value which is derived from the values of the material quality and the outer diameter.

2. An apparatus for discriminating between true and false coins, comprising:

a coin passage along which a coin to be discriminated passes;

exciting means mounted relative to said coin passage for exciting said coin passing along said coin passage by applying an electromagnetic field of given frequency;

detecting means for detecting a state of said coin excited by said exciting means so as to check material quality and an outer diameter of said coin; and discriminating means for discriminating said coin between true and false in accordance with whether or not data detected by said detecting means, representing the material quality and the outer diameter, falls within a circular area on a predetermined two-dimensional coordinate system, the radius of said circular area being represented by a characterizing value which is derived from the values of the material quality and the outer diameter.

3. An apparatus according to claim 2, wherein said discriminating means comprises:

data processing means for executing a function calculation operation for said data;

reference value generating means for generating a reference value representative of said circular area on a coordinate system; and means for discriminating between true and false of said coin by comparing a data from said data processing means with said reference value from said reference value generating means.

4. A method of discriminating between true and false coins by mounting a discriminating means relative to a predetermined passage along which a coin to be discriminated passes, wherein true/false discrimination is carried out in accordance with whether or not three difference data detected from said coin and developed on a three-dimensional coordinate system falls within a closed area representing a predetermined three-dimensional function;

characterized in that said method comprises the steps of;

applying an electromagnetic field of given frequency to a coin which passes along said predetermined passage to excite the coin;

detecting a state of said coin excited by the electromagnetic field; and discriminating said coin between true and false in accordance with whether or not the data representing the state of said coin falls within a spherical area on a predetermined three-dimensional coordinate system which represents three parameters, including material quality and an outer diameter of said coin, the radius of said spherical area being represented by a characterizing value which is derived from the values of the material quality and the outer diameter.

5. An apparatus for discriminating between true and false coins, comprising:

a coin passage along which a coin to be discriminated passes;

exciting means mounted relative to said coin passage for exciting said coin passing along said coin passage by applying an electromagnetic field of given frequency;

detecting means for detecting a state of said coin excited by said exciting means so as to check three parameters including material quality and an outer diameter of said coin; and discriminating means for discriminating said coin between true and false in accordance with whether or not the three data detected by said detecting means fall within a spherical area on a predetermined three-dimensional coordinate system, the radius of said spherical area being represented by a characterizing value which is derived from the values of the material quality and the outer diameter.

6. An apparatus according to claim 5, wherein said discriminating means comprises:

data processing means for executing a function calculation operation for said data;

reference value generating means for generating a reference value representative of said spherical area on a coordinate system; and means for discriminating between true and false of said coin by comparing a data from said data processing means with said reference value from said reference value generating means.

* * * * *